US008745890B2

(12) United States Patent
Niemann et al.

(10) Patent No.: US 8,745,890 B2
(45) Date of Patent: Jun. 10, 2014

(54) TRAY DRYER

(75) Inventors: Arne W Niemann, Inman, SC (US); Helmut T Stueble, Spartanburg, SC (US); Christopher A Sandmeyer, Spartanburg, SC (US)

(73) Assignee: Consultex Systems, Inc., Spartanburg, SC (US)

( * ) Notice: Subject to any disclaimer, the term of this patent is extended or adjusted under 35 U.S.C. 154(b) by 694 days.

(21) Appl. No.: 12/927,514

(22) Filed: Nov. 17, 2010

(65) Prior Publication Data

US 2011/0119948 A1 May 26, 2011

Related U.S. Application Data

(60) Provisional application No. 61/281,841, filed on Nov. 23, 2009.

(51) Int. Cl.
*F26B 11/00* (2006.01)
*F26B 25/18* (2006.01)

(52) U.S. Cl.
USPC ..... 34/186; 34/238

(58) Field of Classification Search
USPC ..... 34/184, 185, 194, 195, 187, 189, 201, 34/209, 108, 168, 179; 110/225; 211/91.04, 91.03
See application file for complete search history.

(56) References Cited

U.S. PATENT DOCUMENTS

| | | | | |
|---|---|---|---|---|
| 8,764 A | | 2/1852 | Weed | |
| 273,767 A | | 3/1883 | Schroeder | |
| 375,737 A | | 1/1888 | Duryea et al. | |
| 864,186 A | | 8/1907 | Ostertag | |
| 1,136,933 A | | 4/1915 | Cameron | |
| 1,172,576 A | | 2/1916 | Benjamin | |
| 1,611,527 A | | 12/1926 | Hilgenberg | |
| 1,680,274 A | * | 8/1928 | Allen et al. | 34/173 |
| 1,706,421 A | | 3/1929 | Trent | |
| 1,823,787 A | | 9/1931 | Connolly | |

(Continued)

FOREIGN PATENT DOCUMENTS

| | | |
|---|---|---|
| CA | 2277226 A1 | 7/1998 |
| CN | 1342257 | 3/2002 |

(Continued)

OTHER PUBLICATIONS

International Searching Authority; International Search Report and Written Opinion of the International Searching Authority; Publisher is Korean Intellectual Property Office; Seo-gu, Daejeon Republic of Korea; International Application No. PCT/US2010/003018; mailing date Aug. 30, 2011; (9 pages).

(Continued)

*Primary Examiner* — Kenneth Rinehart
*Assistant Examiner* — John McCormack
(74) *Attorney, Agent, or Firm* — J. Bennett Mullinax, LLC

(57) ABSTRACT

A tray dryer is provided that has tray stack with trays that rotate about an axis. A material leveler is stationary with respect to the rotating trays and has a leveling surface that engages the product. The material leveler has a plurality of prongs that engage the product and that in combination with the leveling surface form a series of rows in the product on the upper surface of one of the trays. The material leveler does not function to hold the product for transfer to a subsequent tray of the tray stack.

12 Claims, 11 Drawing Sheets

(56) References Cited

U.S. PATENT DOCUMENTS

| | | | | |
|---|---|---|---|---|
| 1,863,109 | A * | 6/1932 | Graves | 426/473 |
| 2,000,817 | A | 5/1935 | Bixby | |
| 2,023,426 | A | 12/1935 | Lasley | |
| 2,228,999 | A | 1/1941 | Birdseye | |
| 2,351,676 | A | 6/1944 | Grandjean et al. | |
| 2,869,249 | A | 1/1959 | Kamp | |
| 3,009,689 | A | 11/1961 | Hinz | |
| 3,538,618 | A * | 11/1970 | Neuenschwander | 34/102 |
| 3,681,855 | A | 8/1972 | Weisselberg et al. | |
| 3,777,409 | A | 12/1973 | Weisselberg et al. | |
| 3,942,960 | A | 3/1976 | Girard | |
| 4,233,752 | A * | 11/1980 | Kleinguenther | 34/331 |
| 4,392,310 | A | 7/1983 | Hohman et al. | |
| 4,769,923 | A | 9/1988 | Chang | |
| 5,878,508 | A | 3/1999 | Knoll et al. | |
| 6,085,442 | A | 7/2000 | Erickson | |
| 6,311,411 | B1 | 11/2001 | Clark | |
| 2007/0169370 | A1 | 7/2007 | Sukup | |

FOREIGN PATENT DOCUMENTS

| | | | |
|---|---|---|---|
| KR | 10-2001-0110653 | A | 12/2001 |
| WO | WO 98/30851 | A1 | 7/1998 |
| WO | WO 00/52407 | A1 | 9/2000 |

OTHER PUBLICATIONS

Wyssmont.com; Web site print outs from http://www.wyssmont.com/product_detail.php?section=Dryers&id=1; visited Nov. 8, 2010; copyright 2008; copyright Wyssmont Inc.; 4 pages).

* cited by examiner

TRAY DRYER

CROSS REFERENCE TO RELATED APPLICATIONS

This application claims the benefit of U.S. Application Ser. No. 61/281,841 filed on Nov. 23, 2009 and entitled, "Tray Dryer." U.S. Application Ser. No. 61/281,841 is incorporated by reference herein in its entirety for all purposes.

FIELD OF THE INVENTION

The present invention relates generally to a tray dryer for use in drying objects such as wood chips and other bulk solids. More particularly, the present application involves a tray dryer that may include features to enhance drying of the product, reduce power needed to rotate trays, and/or optimize the number of trays per unit height of the tray dryer.

BACKGROUND

Tray dryers are known for use in drying various products such as grain, ceramic materials, or coal. Tray dryers typically include a central, vertically oriented shaft to which a number of trays are attached and horizontally disposed. The central shaft and trays may be encased within an outer shell. Product to be dried is placed onto a tray that rotates due to rotation of the central shaft. A leveler arm can be attached to an inner wall of the shell or other structure next to the rotating trays. The product may contact the leveler arm and hence leveled upon rotation of the tray under the leveler arm.

The tray dryer can also include a scraper arm that with the leveler arm may be attached to the inner wall of the shell or to another structure that does not move with respect to the trays. Rotation of the tray under the scraper arm functions to scrape or hold the product in position while the tray continues to move under the scraper arm. The floor of the tray can include an opening so that further rotation of the tray will cause the opening to be under the product held by the scraper thus causing the product to fall through the opening via gravity. The product may then fall to a subsequent, lower tray and the process can be repeated. A fan can be incorporated into the tray dryer to create air flow through the device that can function to dry the product. The product can be dried over the course of its travel through the multiple occurrences of leveling, scraping, and falling. The product may be emptied into a removal conduit at the bottom of the tray dryer and subsequently processed or packaged.

Although capable of drying product, tray dryers require a powerful prime mover due to attachment of the rotating trays to the central shaft. Further, the suspension of trays from the central shaft requires supporting structures such as ribs be present to prevent bending thus decreasing the number of trays that can be used in a given height. Also, air flow through the tray dryer is effected in a random manner without deliberate movement of the air or optimization of the drying function of the air on the product. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
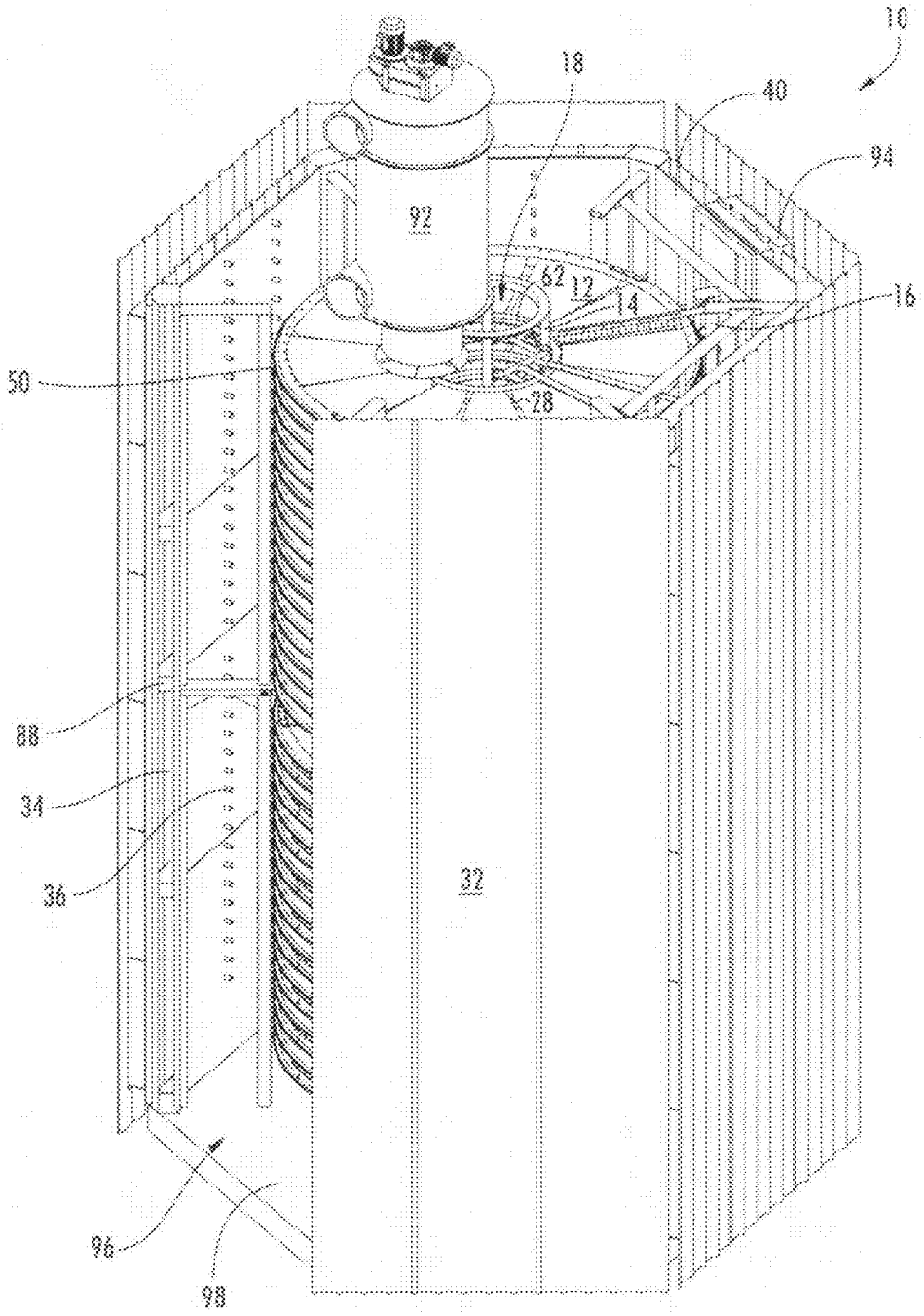
FIG. 1 is a perspective view of a tray dryer in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a tray dryer 10 that is capable of drying product 84 that may be, for example, wood chips. The tray dryer 10 may include an air flow pattern in which air is moved from an outer edge 50 of a tray 12 to an inner edge 62 of the tray 12 and then exhausted through a central opening 18 of the tray stack 17. The tray dryer 10 may also include a material leveler 22 that includes one or more prongs 24 that function to form rows 86 into the product 84 to achieve enhanced drying of the product 84. Additionally or alternatively, the tray dryer 10 may include trays 12 that are supported on rollers 58 and 60 on opposite ends so that the trays 12 are not attached to or driven by a central shaft. A driving mechanism may be included that drives the tray 12 from the outer edge 50 and can be arranged so that a subsequent tray 13 in the tray stack 17 rotates in a direction opposite to that of tray 12.

Figure 2:
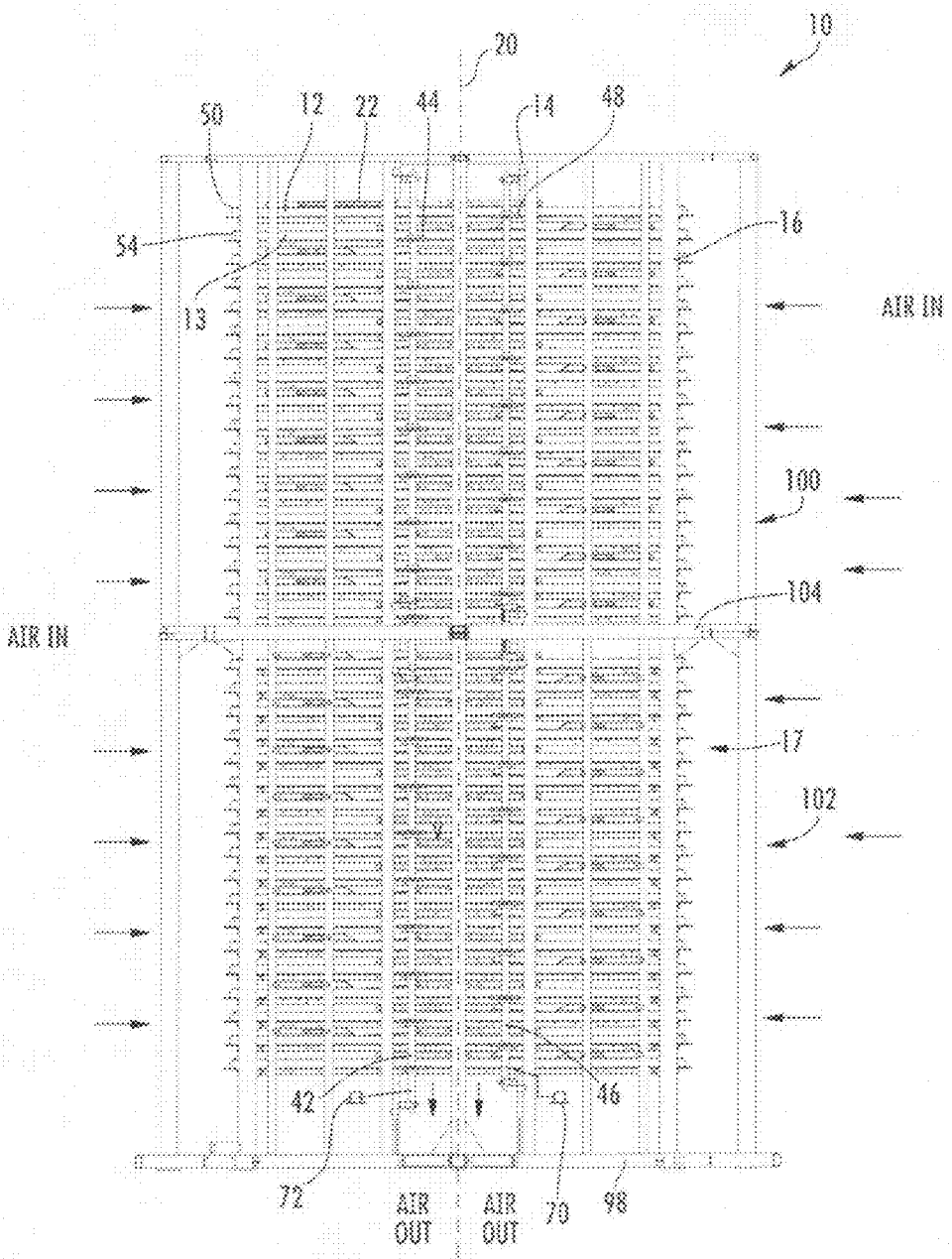
FIG. 2 is a side elevation view of portions of the tray dryer of FIG. 1 showing the general flow of air through the tray dryer.

FIGS. 1 and 2 illustrate a tray dryer 10 in accordance with one exemplary embodiment. Product 84 may be transferred through a feed airlock 92 and then dispensed onto a tray 12 of the tray dryer 10 for drying. In other arrangements, different types of devices may be used to place the product 84 onto the tray 12. For example, a product hopper may be used to place the product 84 onto tray 12 in other versions of the tray dryer 10. The feed airlock 92 functions to spread the product 84 onto the tray 12 by means of a rotating spreader at its bottom. The tray 12 may be the uppermost tray of the tray dryer 10 and in some embodiments may be the upper most portion of the tray dryer 10 that is capable of rotating about axis 20. The feed airlock 92 has helical arms that function to compress product 84 that is fed into the feed airlock 92. Also, a cone with a wire mesh is located inside of the feed airlock 92 and surrounds the helical arms. The product 84 is compacted into a solid plug of material and this plug functions as an air lock to separate the air from inside of the feed airlock 92 from the air in the tray dryer 10 that is injected onto the trays 12. The solid plug of product 84 is pushed through a diaphragm that further functions to prevent the air from inside the feed airlock 92 from mixing with the air inside the tray dryer 10 that is injected from the air diffusers 36. The solid plug of product 84 is dropped onto the spinning disk of the feed airlock 92 and is evenly distributed across the tray 12. Two motors may be present in affiliation with the feed airlock 92. The first may be a motor that rotates at 2-3 rpm for driving the helical arms, and the second motor may be a faster motor for use in driving the spinning disk. This second motor may rotate at 240 rpm in certain arrangements.

The tray dryer 10 may include an outer shell 32 and an inner shell 40 that function to define one or more air plenum chambers 34 therebetween. The inner shell 40 may be spaced a distance from one to two feet from the outer shell 32 in accordance with certain exemplary embodiments. Dividers 88 may be present between the inner shell 40 and the outer shell 32 to form a series of isolated air plenum chambers 34 in certain exemplary embodiments. Each isolated air plenum chamber 34 may extend around the circumference of the inner and outer shells 40 and 32. Although not shown in the figures, air may be injected into the air plenum chambers 34 either individually or through communication with a single conduit. The air can be injected into the sides, top, and/or bottom of the air plenum chambers 34 and may be slightly pressurized so that the air pressure within the air plenum chambers 34 is high thus tending to want to exit from the chambers 34. The air may be dispensed from the air plenum chambers 34 by way of a series of air diffusers 36 located through the side of the inner shell 40. Any number or type of air diffusers 36 may be used to cause air to be injected into the interior of the inner shell 40. In accordance with one exemplary embodiment, the air diffusers 36 are nozzles. The air diffusers 36 associated with each air plenum chamber 34 may be sized, shaped, numbered and arranged in a manner identical to or different from that of the air diffusers 36 associated with the other air plenum chambers 34.

Any number of air plenum chambers 34 can be present. As shown, four air plenum chambers 34 are present and are at least partially formed and separated by three dividers 88 along with a bottom plate 98 and a top plate of the tray dryer 10. Each of the four air plenum chambers 34 can be a different zone of the tray dryer 10 that have an independently controlled temperature and flow rate. In this regard, the top plenum chamber 34 can dispense air through associated diffusers 36 that is at a high flow rate and a high temperature. The three plenum chambers 34 below the top plenum chamber 34 may dispense air through associated diffusers 36 that is at a flow rate and temperature that are lower than those associated with the very top plenum chamber 34. Each successively lower air plenum chamber 34 may dispense air at a successively lower flow rate and temperature than that of the air plenum chamber 34 immediately above/preceding. In this regard, none of the four air plenum chambers 34 may cause the same air flow rate or temperature to be dispensed. The variations in flow rate and temperature may be due to the pressure and temperature of air injected into the particular air plenum chamber 34 and/or may be due to the configuration and number of air diffusers 36 of each one of the air plenum chambers 34. It is to be understood that other arrangements are possible in which all of the air plenum chambers 34 cause air of the same temperature and flow rate to be imparted onto all of the trays 12 of the tray dryer 10.

A row of air diffusers 36 may be associated with each one of the trays 12 of the tray stack 17. However, other exemplary embodiments are possible in which a single row of diffusers 36 is associated with from eight to ten trays 12 of the tray stack 17 that are adjacent to one another. In accordance with one exemplary embodiment, at least one air diffuser 36 is associated with each one of the trays 12 of the tray stack 17 so that every tray 12 has at least one air diffuser 36 injecting air onto the product 84 located on the tray 12. A fan or other mechanism may be used to drive air from the air plenum chambers 34 to the trays 12.

An access door 94 can be included in the tray dryer 10 so that maintenance personnel can access the trays 12 and other, interior, portions of the tray dryer 10. A pair of access doors 94 may be included and can be located 180° opposite from one another about the axis 20 in certain exemplary embodiments. In other embodiments, a single access door 94 is present. As shown in FIG. 1, a single access door 94 is present and is closed while an opening 96 is oppositely disposed 180° about axis 20. The opening 96 is disposed through both the outer shell 32 and the inner shell 40 and is provided in order to illustrate interior components of the tray dryer 10. It is to be understood that the opening 96 need not exist in the actual tray dryer 10 but is instead present in order to illustrate certain components of the tray dryer 10. In one embodiment, inlet connections for duct work to the plenum chambers 34 is present at the location of opening 96 and is not shown in FIG. 1 for sake of clarity and to illustrate interior components of the tray dryer 10. The tray dryer 10 is arranged so that the axis 20 extends perpendicular to the ground and so that the trays 12 are arranged in a vertical stack. The bottom plate 98 may thus be closer to the ground than all of the trays 12. The access doors 94 can extend in the vertical direction from the bottom plate 98 to the top plate so that the access doors 94 in effect extend the same height or extend a greater height than the entire stack of trays 12 in the vertical direction.

With respect to FIG. 2, an elevation view of the tray dryer 10 is shown in which the base 98 is located on the ground or alternatively is located closest to the ground with the rest of the tray dryer 10 extending upwards therefrom. The tray dryer 10 may be composed of two pieces, an upper half 100 and a lower half 102, for assembly purposes. The upper half 100 and lower half 102 may contain an equal or unequal amount of trays 12 and lengths of inner support columns 14, outer support columns 16, outer shell 32, and inner shell 40. The upper half 100 and lower half 102 may engage one another at junction 104 and can be secured to one another at this location. It is to be understood that in other arrangements of the tray dryer 10, the upper and lower halves 100 and 102 are not present such that the tray dryer 10 is not a pair of separate halves that are assembled onto one another.

As shown, air is injected into the tray dryer 10 in the inwards radial direction along the entire vertical height of the stack of trays 12. Air is outlet or exhausted from the interior of the tray dryer 10 through the bottom of the central opening 18 in the interior of the tray dryer 10. Although the air could be outlet or exhausted through the top of the tray dryer 10 in other embodiments, particles that fall off of or through the trays 12 may fall to the bottom of the tray dryer 10 due to gravity and thus exhaust of the air through the bottom of the tray dryer 10 facilitates removal of such particles.

Figure 3:
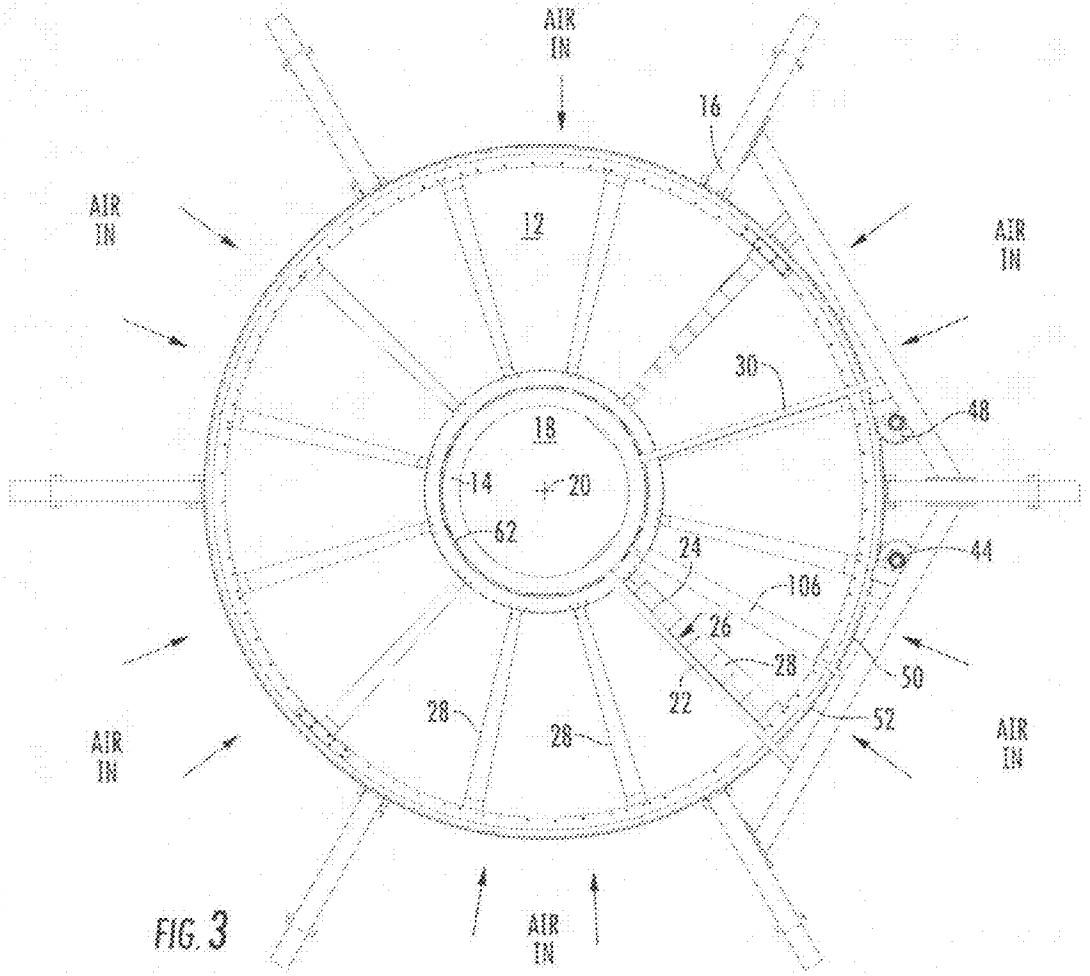
FIG. 3 is a plan view of the tray dryer of FIG. 1 above one of the trays of the tray dryer.

FIG. 3 shows a plan view of the tray 12 and the air flow direction of the air from the air diffusers 36 over an outer edge 50 of the tray 12. The air flows radially inwards towards an inner edge 62 of the tray 12 and then into a central opening 18 defined at the center of the tray stack 17. As illustrated, the tray dryer 10 lacks a central shaft and instead includes a central opening 18. A series of outer support columns 16 may support the tray 12 at the outer edge 50, and an inner support column 14 may support the tray 12 at the inner edge 62. The inner support column 14 is in the shape of a ring, although it is to be understood that the inner support column 14 may be variously shaped and that there may be multiple inner support columns 14 in other exemplary embodiments. Each one of the trays 12 may be associated with an individual material leveler 22 and a scraper 30. The material leveler 22 may be attached to an outer support column 16 and/or to an inner support column 14. As such, the material leveler 22 may remain stationary with respect to the tray 12 that is capable of rotating with respect to both the inner and outer support columns 14 and 16. Product 84 that is deposited onto the tray 12 can be leveled by the material leveler 22 as the rotating tray 12 moves under the stationary material leveler 22. The product 84 can thus be spread out in a more even manner across the surface of the tray 12 through engagement with the material leveler 22 that functions in combination with air flow directed onto the product 84 to increase drying. The tray 12 may continue to rotate so that the product 84 is subjected to air flow from air diffusers 36 located around the perimeter of the outer edge 50.

The tray 12 may include a series of openings 28 located through the surface of the tray 12 that extend in the radial direction so as to extend in a linear fashion from an axis 20 located at the center of the central opening 18. The openings 28 may extend from the outer edge 50 to the inner edge 62 of the tray 12. Any number of openings 28 through the floor of the tray 12 may be included. For example, from 1 to 10 openings 28 may be present in certain embodiments. In other embodiments of the tray dryer 10, up to 50 openings 28 can extend through the tray 12. The scraper 30 can be attached to the inner support column 14 and/or the outer support column 16 so that the scraper 30 remains stationary with respect to the rotating tray 12. The product 84 will engage the scraper 30 as the tray 12 passes under the scraper 30 so that the product 84 is scraped off of the tray 12 and onto the scraper 30 or is alternatively or additionally pushed along the tray 12. Eventually, the opening 28 in the tray 12 will move past the scraper 30 or under the product 84 so that the product 84 falls through the opening 28 and down onto the tray 13 located immediately below the tray 12. This falling action of the product 84 will also function to dry the product 84 as air flow will likewise be present against the tray 13 by way of injection of air from air diffusers 36 associated with the tray 13. Although shown as incorporating the material leveler 22 and the scraper 30, it is to be understood that these components need not be present in accordance with other exemplary embodiments. Further, these components need not be stationary with respect to the tray 12 but may rotate with the tray 12 in other exemplary embodiments.

Figure 4:
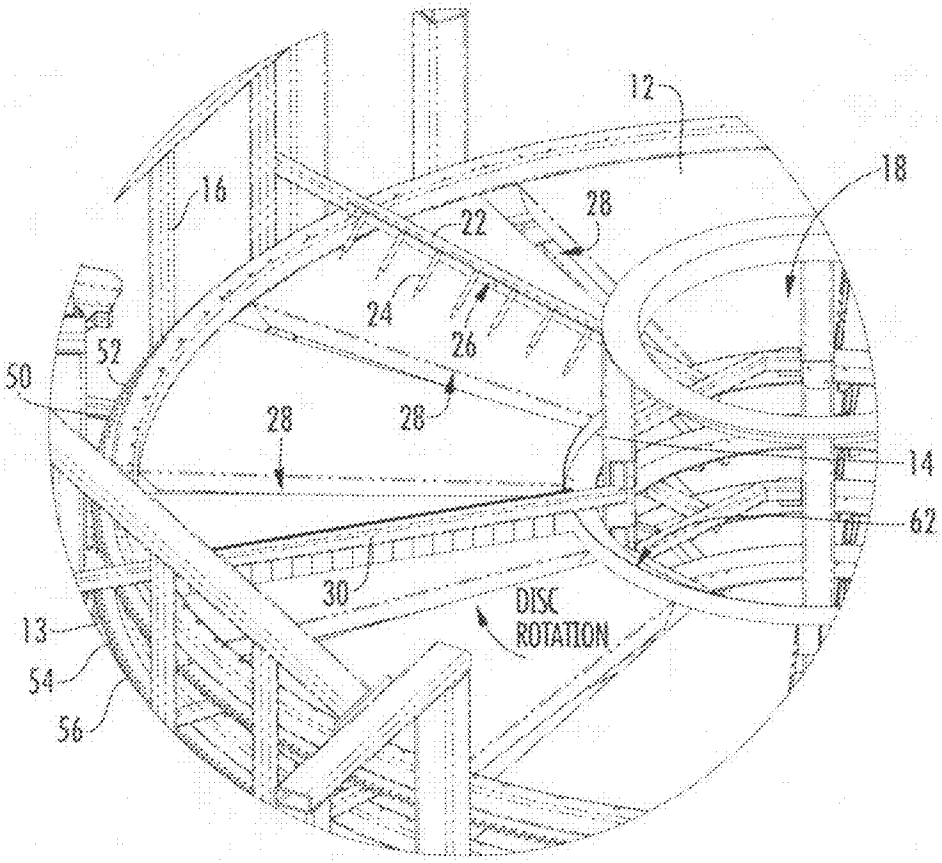
FIG. 4 is a perspective view of a portion of the tray dryer of FIG. 1 that shows a material leveler in conjunction with a tray of the tray dryer.

The material leveler 22 is shown in greater detail with reference to FIG. 4. The material leveler 22 is located a distance above the surface of the tray 12 and has a leveling surface 26 that faces the direction of travel of the tray 12 such that product 84 on the tray 12 moves into engagement with the leveling surface 26. The leveling surface 26 may be perpendicular to the top surface of the tray 12, or may be angled with respect to the top surface of the tray 12 in other exemplary embodiments. Leveling surface 26 may extend in a horizontal direction so that it is not angled with respect to the tray 12 in certain exemplary embodiments. Further, the leveling surface 26 may be completely radial with respect to the axis 20 and may not be angled with respect to the axis 20 in certain arrangements. Product 84 coming into contact with the leveling surface 26 may be smoothed so that the uppermost surface of the product 84 is flat upon being moved past the material leveler 22.

A series of prongs 24 are also located on the material leveler 22 and extend from the leveling surface 26. The prongs 24 extend so as to face the direction of travel of the tray 12 such that product 84 on the tray 12 will engage the prongs 24 before engaging the leveling surface 26 upon rotation of the tray 12. In other embodiments, the prongs 24 may be on the opposite side of the material leveler 22 as the leveling surface 26. The prongs 24 may extend along the entire length of the material leveler 22 in the radial direction or along only a portion of its length in certain arrangements. The prongs 24 may all be equally spaced from one another or may be spaced different distances from one another in the radial direction in accordance with certain exemplary embodiments. The prongs 24 may be variously shaped. For instance, the prongs 24 may be cylindrical members having points at their distal ends, rectangular members having the same shape along their lengths, or triangularly shaped members in certain embodiments.

The prongs 24 may be arranged so that they extend at an angle to the top surface of the tray 12. In this regard, the prongs 24 can be arranged at a 45° angle to the top surface of the tray 12 so that the distal end of the prongs 24 are closer to the tray 12 than the proximate ends of the prongs 24 that are adjacent the leveling surface 26. Other arrangements are possible in which the prongs 24 are angled 30° to the top surface of the tray 12, from 5° to 85° to the top surface of the tray 12, or up to 60° to the top surface of the tray 12. In certain arrangements, some of the prongs 24 are arranged at different angles to the top surface of the tray 12 than other ones of the prongs 24. The angles thus described may be measured between the leveling surface 26 and the prongs 24 so that a 5° angle as previously mentioned is very close to pointing straight down at the top surface of the tray 12, while an 85° angle is close to being parallel to the top surface of the tray 12 and lays almost flat thereon. The prongs 24 may be arranged at any angle with respect to the top of the tray 12 in other arrangements and the tray dryer 10 is not limited to a single angle or range of angles. The prongs 24 are arranged so that the distal pointed tip of the prongs 24 are located at a different arc length or circumferential location about axis 20 than the proximal base of prongs 24 that engage the leveling surface 26. The prongs 24 need not be angled with respect to the top surface of the tray 12 in other arrangements of the tray dryer 10. The leveling surface 26 may be angled with respect to the upper surface of the tray 12 the same amount as the prongs 24. Alternatively, the leveling surface 26 may be perpendicular and thus oriented at a 90° angle to the upper surface of tray 12 while the prongs 24 are not perpendicular to the upper surface of tray 12 but rather extend at an angle to tray 12 such as from 5° to 85° as previously discussed.

The prongs 24 provide the material leveler 22 with a rake-like configuration. Although capable of leveling or shaping the product 84, the material leveler 22 may in other arrangements function only to hold and/or push the product 84 to an adjacent tray 13. In still further embodiments, the material leveler 22 may function only to shape the product 84 and maintain the product 84 on the surface of the tray 12. In yet other arrangements, the material leveler 22 functions to both shape the product 84 and to hold and/or push the product 84 to the subsequent tray 13. As shown in FIG. 4, the inner support column 14 may be a series of vertically extending columns and generally horizontally extending rings that form a structure that provides a base to allow the trays 12 to be disposed thereon. However, the inner support column 14 can be variously configured in other arrangements and need not include the horizontal ring structure.

Figure 10:
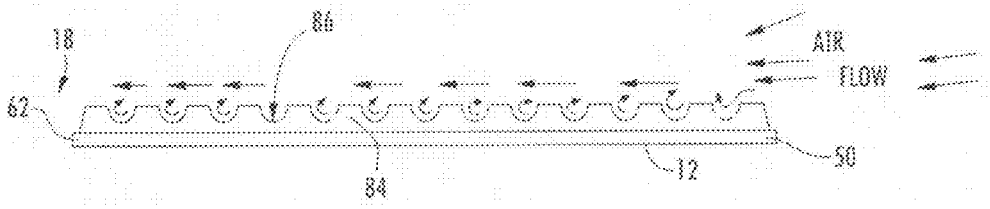
FIG. 10 is a side elevation view of a tray of the tray dryer with product located thereon that is spread into rows.
Figure 11:
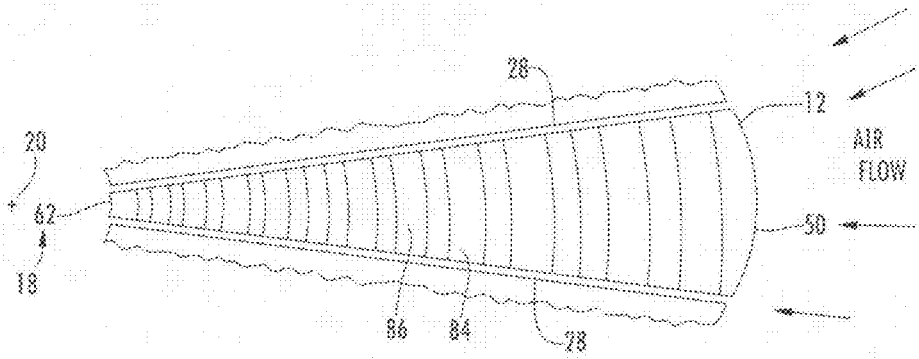
FIG. 11 is a plan view of a portion of the tray of FIG. 10.

The prongs 24 function to form rows 86 into the product 84 that may be more easily seen with reference to FIGS. 10 and 11. Engagement of the prongs 24 with the product 84 causes the product 84 to be pushed down, and subsequent engagement of the product 84 by the leveling surface 26 acts to flatten the uppermost surface of the product 84 as shown. The rows 86 may be concentrically arranged with respect to one another so that they share a common radius of curvature. The rows 86 may be arc shaped with a center of curvature corresponding to the axis 20 of the central opening 18. The prongs 24 may function to form rows 86 without agitating the product 84 or pushing the product 84 off of the tray 12. As with the prongs 24, adjacent rows 86 can be spaced the same distance from one another or may be spaced varying distances from one another in accordance with different exemplary embodiments. In accordance with one exemplary embodiment, the rows 86 are spaced approximately six inches center to center from one another. The concentric rows 86 may extend any amount of arc length around the axis 20. For example, the concentric rows 86 may extend around 180°-220°, around 220°-240°, or up to 310° about axis 20. The material leveler 22 can be arranged so that it does not agitate or otherwise disturb the product 84 as the product 84 moves past the material leveler 22, but rather only levels the product 84 and form rows 86 therein. Further, material leveler 22 can be arranged so that it does not function to push the product 84 off of the tray 12 to the subsequent tray 12.

As used herein, the term concentric is understood to mean the rows 86, or other element described as being concentric, share a common center which is their center of curvature. The rows 86 that are concentric thus extend around a common center of curvature, which may be axis 20, and may extend completely 360° around the center of curvature or may extend any lesser amount around the center of curvature such as 270°. Therefore, elements that are stated as being concentric need not extend completely 360° around a particular point or axis but only need share some common point or axis with one another as to one or more of their properties.

Air flow from the air diffusers 36 is directed onto the product 84 and flows over the upper surface thereof. The presence of the rows 86 function to redirect the flow of air across the upper surface of the product 84. In this regard, the air flow will extend transversely across the length of the rows 86 to form a turbulent air flow in the rows 86 that may extend to the uppermost, level surface of the product 86. In certain exemplary embodiments, the air flow within the rows 86 will be turbulent while the air flow against the uppermost, level portions of the product 86 will be laminar. Turbulent air flow functions to increase the drying of the product 86 versus the situation in which the rows 86 are not present. The product 86 can thus be more quickly dried through the presence of the rows 86. The air flow will again travel across the inner edge 62 and enter the central opening 18 and be subsequently exited from the tray dryer 10. Although shown as having a generally clockwise direction in the rows 86, the air may be counter clockwise or completely turbulent to the point that a recognizable direction cannot be ascertained in accordance with various exemplary embodiments.

The tray dryer 10 may have a driving mechanism that functions to rotate the trays 12 in opposite directions. In this regard, a first tray 12 may rotate counterclockwise while a subsequent, adjacent tray 13 immediately below the first tray 12 may rotate in a clockwise direction. Next, the third tray in sequence (the one immediately below the second tray 13) may rotate in a counterclockwise direction. All of the trays in the tray stack 17 can be arranged so that every tray rotates in a direction opposite to that of the immediately adjacent tray both above and below the tray in question. The bottom most tray and top most tray may likewise move in opposite direction than the trays adjacent thereto. However, it is to be understood that other arrangements are possible in which all of the trays 12 rotate in the same direction. Further, additional exemplary embodiments are possible in which some of the trays 12 rotate clockwise and other trays 12 rotate counterclockwise such that some of the trays 12 immediately adjacent one another rotate in the same direction.

Figure 5:
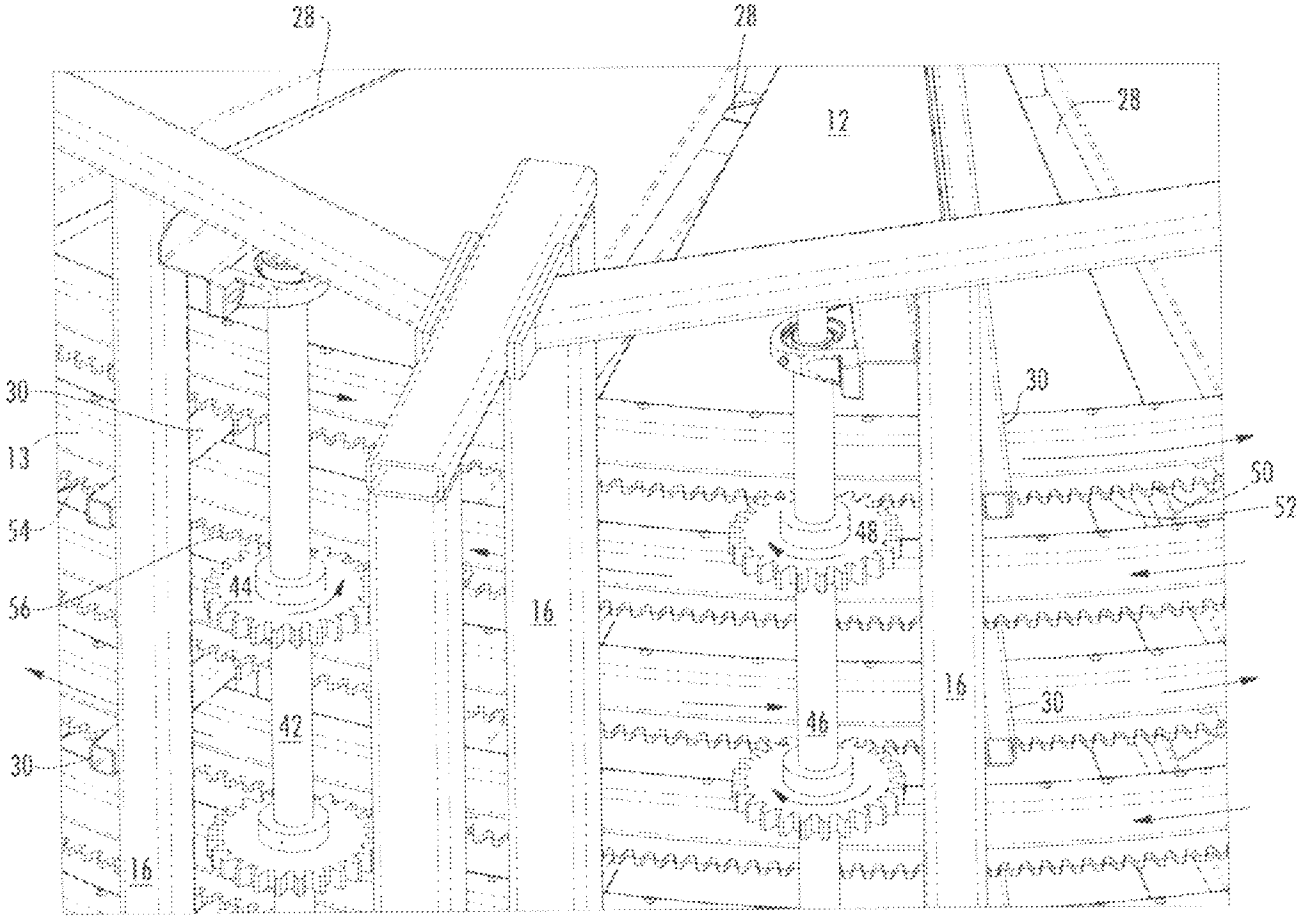
FIG. 5 is a perspective view of the tray dryer of FIG. 1 that shows a portion of a driving mechanism that functions to rotate the trays of the tray dryer.

With reference back to FIG. 2, a motor 70 is shown that is geared to a clockwise driving shaft 46. A second motor 72 is shown and is geared to a counterclockwise driving shaft 42. Although shown as employing separate motors 70 and 72, it is to be understood that a single motor may be used in other exemplary embodiments. Here, a drive train can be developed that allows the single motor to function to rotate shafts 42 and 46 in opposite directions. Referring now to FIG. 5, both the counterclockwise driving shaft 42 and the clockwise driving shaft 46 are attached to the outer support column 16. The shafts 42 and 46 may be mounted within bearing housings that are attached rigidly to different ones of the vertical support columns 16 so that the shafts 42 and 46 can rotate with respect to the various support columns 16. In other arrangements, the shafts 42 and 46 need not be mounted to different vertical support columns 16 but may be attached to the same vertical support column 16 or other members located proximate to the outer edges 50 of the trays 12.

The counterclockwise driving shaft 42 with associated counterclockwise driving gears 44 are attached to the same outer vertical support column 16 to which all of the sweepers 30 are attached and contact that sweep product 84 from the trays 12 driven by the counterclockwise driving gears 44. In a similar manner, the clockwise driving shaft 46 and associated clockwise driving gears 48 are attached to the same outer vertical support column 16, although a different outer vertical support column 16 to which the counterclockwise driving shaft 42 is attached, to which the sweepers 30 are attached and contact that sweep product 84 from the trays 12 driven by the clockwise driving gears 48. This arrangement causes zero counteracting forces to be realized so that there are zero forces between the sweepers 30 and gears 44 and 48. However, it is to be understood that the sweepers 30 need not be attached to the same outer vertical support columns 16 as the gears 44 or 48. In this regard, the sweepers 30 associated with the same trays 12 as the gears 44 may be attached and contact a different vertical support column 16 than the one to which the gears 44 are attached. Further, the sweepers 30 associated with the same trays 12 as the gears 48 may be attached and contact a different vertical support column 16 than the one to which the gears 48 are attached. Also, the sweepers 30 can be attached to different vertical support columns 16 in other embodiments and need to be attached and contact only two of the vertical support columns in total as disclosed in the illustrated and discussed embodiment. Attachment of the gears 44 to a vertical support column 16 and attachment of the gears 48 to a different vertical support column 16 may reduce bending in the tray dryer 10 as opposed to the configuration where the gears 44 and 48 were all attached to the same vertical support column 16.

The clockwise driving shaft 46 includes a clockwise driving gear 48 that engages external teeth 52 located on the outer edge 50 of the tray 12. The external teeth 52 may extend completely around the outer edge 50 of tray 12 and mesh with the clockwise driving gear 48 so that rotation of the clockwise driving gear 48 in the clockwise direction causes the tray 12 to rotate in the counterclockwise direction. Multiple clockwise driving gears 48 may be disposed along the length of the clockwise driving shaft 46 and engage external teeth 52 located on various trays 12 so that half of the trays 12 of the tray stack 17 can be driven in the counterclockwise direction upon rotation of shaft 46.

The counterclockwise driving shaft 42 may include a counterclockwise driving gear 44 that can engage external teeth 56 located at the outer edge 54 of the tray 13 immediately adjacent and below tray 12. Rotation of the driving shaft 42 causes rotation of the attached driving gear 44 in the counterclockwise direction thus imparting clockwise rotation to the tray 13 due to meshing between the counterclockwise driving gear 44 and the external teeth 56. The external teeth 56 can extend around the entire length of the outer edge 54 so that the tray 13 can be completely rotated. Multiple counterclockwise driving gears 44 can be attached along the length of the counterclockwise driving shaft 42 in a staggered relation to the clockwise driving gears 48 so that trays 12 not engaged by the clockwise driving gears 48 are engaged by the counterclockwise driving gears 44. These additional trays 12 may likewise contain external teeth on their outer surfaces to accept rotational movement of the gears 44. As previously discussed, successive trays 12 in sequence may rotate opposite to one another.

All of the trays 12 of the tray stack 17 may thus be driven via gearing onto their outer edges 50. Such an arrangement allows for the motors 70 and 72 to be of lesser horsepower than equivalent motors that may be used to drive a center shaft of the tray dryer 10 to effect rotation of the trays 12. The trays 12 may thus be thought of as a gear themselves due to the external gearing on their outer edges. However, it is to be understood that other arrangements of effecting rotation of the trays 12 of the tray stack 17 may be used in other exemplary embodiments. Driving of the trays 12 so that immediately adjacent trays 12 rotate in opposite directions may allow for more product 84 to be put onto a tray 12 as the opposite rotation may allow for the product 84 to be spread out to a greater degree. Such an arrangement may subsequently allow for a reduction in the size of the material leveler arm 22.

Figure 6:
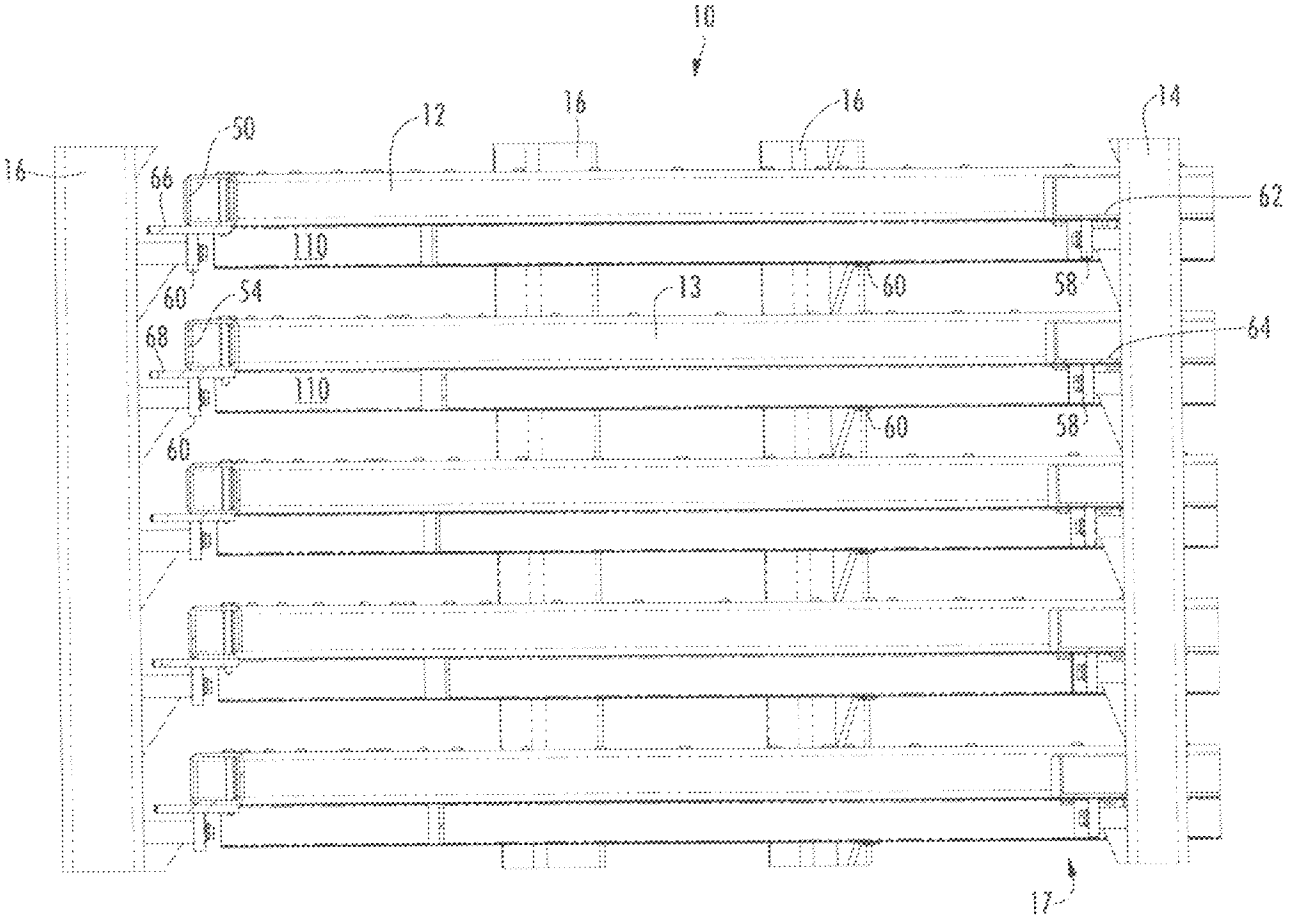
FIG. 6 is an elevation view of a portion of the tray dryer of FIG. 1 that shows supporting structure for the trays.

As previously mentioned, the tray dryer 10 need not include a central shaft that functions to support the trays 12 or other elements of the tray dryer 10. FIG. 6 illustrates an arrangement of supporting the trays 12 of the tray stack 17 in accordance with one exemplary embodiment. As shown, the outer support columns 16 may have a series of rollers 60 extending therefrom. The outer edge 50 of the tray 12 can rest onto the rollers 60 that act to support the tray 12 and allow for rotational movement of the tray 12. The connection between the outer edge 50 and the rollers 60 may be effected in a variety of manners so that the tray 12 is locked onto the rollers 60 and not allowed to move in the radial direction with respect to the rollers 60. The inner support columns 14 may include a plurality of rollers 58 extending therefrom. The inner edge 62 of the tray 12 can rest onto the rollers 58 so that the rollers 58 both support the tray 12 and allow for rotation of the tray 12. The connection between the rollers 58 and the inner edge 62 may be made in a variety of manners so that radial movement of the tray 12 with respect to the rollers 58 is prevented or limited. The tray 12 may thus be completely supported by rollers 58 and 60 and need not be rigidly connected to a rotating shaft. Subsequent trays 13 of the tray stack 17 may be mounted and arranged in a similar fashion. For instance, immediately adjacent tray 13 can be situated so that its outer edge 54 rests onto rollers 60 on the outer support column 16, and so that its inner edge 64 rests onto rollers 58 on the inner support column 14. As such, all of the trays 12 of the tray stack 17 can be mounted and supported in an identical fashion. However, it is to be understood that other arrangements are possible in which some of the trays 12 are mounted and supported in one manner, and in which other trays 12 of the tray stack 17 are mounted and supported in a different manner. The trays 12 of the tray stack 17 are modular in that they are several components that are attached to one another. However, the trays 12 may be a single ring and hence a single component in accordance with other exemplary embodiments.

Figure 7:
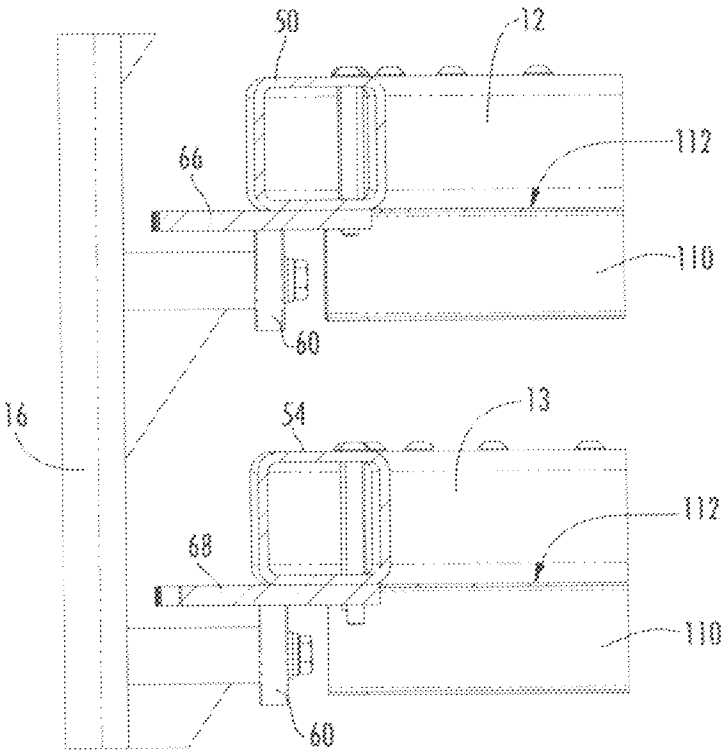
FIG. 7 is a close-up elevation view of a portion of a tray dryer that shows an arrangement for supporting the tray dryer.

FIG. 7 illustrates one exemplary embodiment of the connection between the outer edge 50 and the roller 60. As shown, the outer edge 50 may include a flange 66 that rests onto the roller 60. The roller 60 need not be encapsulated by the outer edge 50, and the sizing of the flange 66 with respect to a lip of the roller 60 may be made so as to maintain the radial relationship between the roller 60 and the tray 12. The outer edge 50 can include a square tubular cross-sectional shaped member that extends around the entire outer circumference of the tray 12 and with the flange 66 forms the outer edge 50 of the tray 12. The tray 12 need not have the flange 66 in other embodiments and instead the roller 60 can directly engage the square tubular cross-sectional shaped member that makes up the outer edge 50. Additional trays 12 in the tray stack 17 can be arranged in a similar fashion. For instance, the immediately adjacent tray 13 can have an outer edge 54 that includes a flange 68 that rests onto roller 60 in a fashion similar to flange 66 of the immediately adjacent tray 12. The outer edge 54 may also include a square tubular cross-sectional shaped member. Support of the trays 12 at the outer edge 50 and/or inner edge 62 may reduce the amount of reinforcing material needed to hold the trays 12 in position and prevent them from sagging along their radial lengths. In this manner, a greater number of trays 12 can be included per unit height of the tray dryer 10 so that increased drying may be realized upon a tray dryer 10 having the same height as a tray dryer 10 that does not have trays 12 supported at the outer edges 50 and/or inner edges 62. The trays 12 may include a pair of bottom flanges 110 that extend downward from the flat upper surface 112 portion of the trays 12. In FIG. 7, the second bottom flange 110 is directly behind the visible bottom flange 110 and is not illustrated. The bottom flanges 110 of the trays 12 provide strength to the trays 12. However, it is to be understood that the bottom flanges 110 need not be present in other exemplary embodiments. The product 84 rests on the upper surface 112 of the tray 12. The outer edge 50 of the tray 12 can extend in the vertical direction upwards and beyond the upper surface 112.

Figure 8:
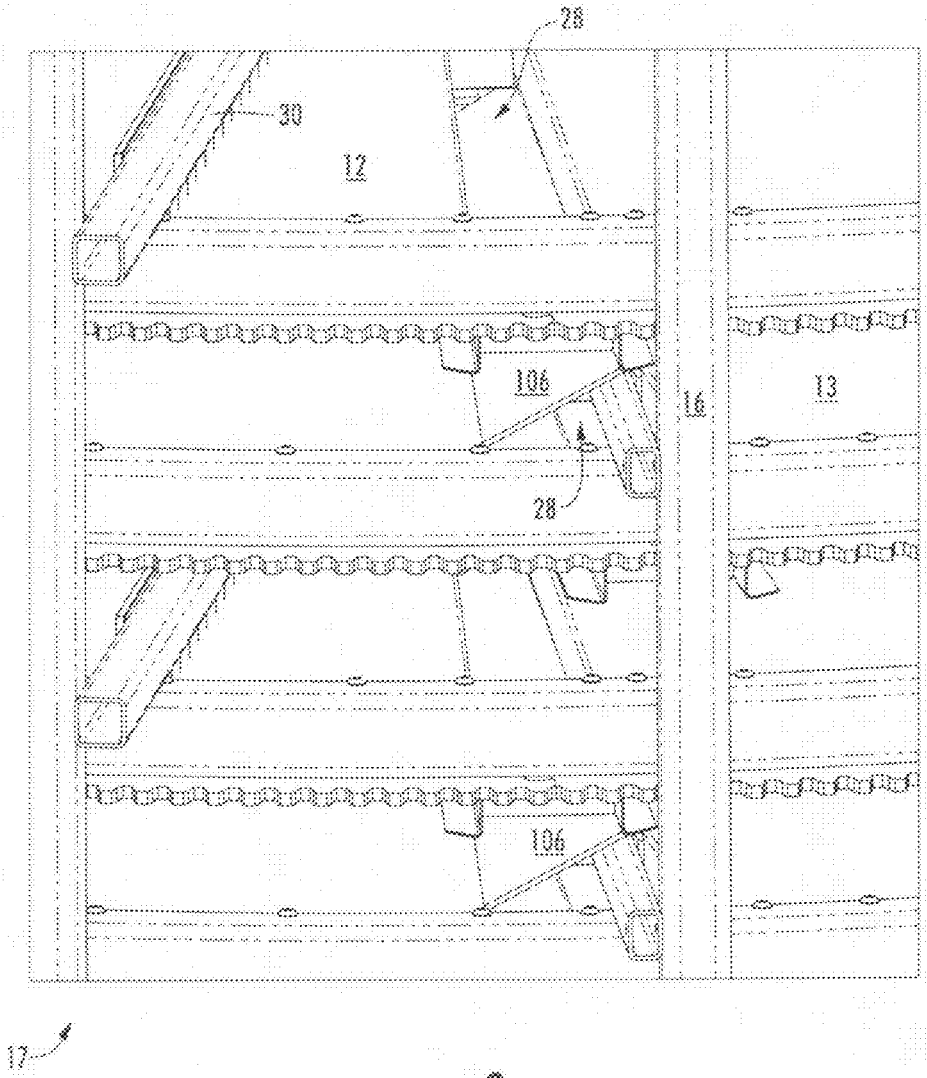
FIG. 8 is a perspective view of a portion of the tray dryer that shows deflectors.

The tray dryer 10 transfers product 84 to successive trays 12 in order to facilitate drying and transfer of the product 84 through the tray dryer 10. The geometry of the openings 28 in the successive trays 12 along with the relative rotational motion of the various trays 12 may result in two successive trays 12 being aligned in such a manner that an opening 28 in one tray 12 may be directly vertically above an opening 28 of the tray 12 immediately below the first tray 12. For example, as shown in FIG. 8, an opening 28 of tray 12 may be aligned directly vertically above an opening 28 of tray 13 that is immediately below tray 12. The aligned openings 28 are located at the same circumferential location and arc length about axis 20. Product 84 may be pushed off of the tray 12 via sweeper 30 to fall through opening 28 of tray 12. If the openings 28 of successive trays 12 and 13 are aligned when product 84 is so pushed, the product 84 may fall through both of the openings 28 and onto a third tray 12 immediately below tray 13, or even yet through additional aligned openings 28 if the tray stack 17 is so arranged. This will cause the product 84 to bypass placement onto tray 13 and will necessarily reduce the drying of the product 84 that falls through successive, aligned openings 28. In order to ensure product 84 is not dropped through successive aligned openings 28 a deflector 106 is provided. Deflector 106 is mounted to support column 16 so that it is rigid with respect to the support column 16 such that the trays 12 move relative to the deflector 106. Deflector 106 is located in such a circumferential position with respect to axis 20 that it functions to block opening 28 of tray 13 when the openings 28 of trays 12 and 13 are aligned. Product falling through opening 28 of tray 12 will contact deflector 106 so as to be directed onto tray 13 and prevented from passing through the successive opening 28 of tray 13.

The deflector 106 is angled downwards from its attached end to its free, distal end towards the tray 13 onto which deflected product 84 is deposited by the deflector 106. The deflector 106 may be angled in this direction at any amount. For example, the deflector 106 may be angled in this direction 45°, from 30-60°, or up to 85°. Deflectors 106 are provided in association with every other tray 12 of the tray stack 17 in the vertical direction. For example, as shown with reference to FIG. 8, a second deflector 106 is below the deflector 106 associated with noted tray 13 with another tray located between these two deflectors 106. This arrangement is due to the geometry of the openings 28 on the various trays 12 and when and where they align during rotation of the tray stack 17. The deflectors 106 can be provided anywhere such alignments occur.

Figure 9:
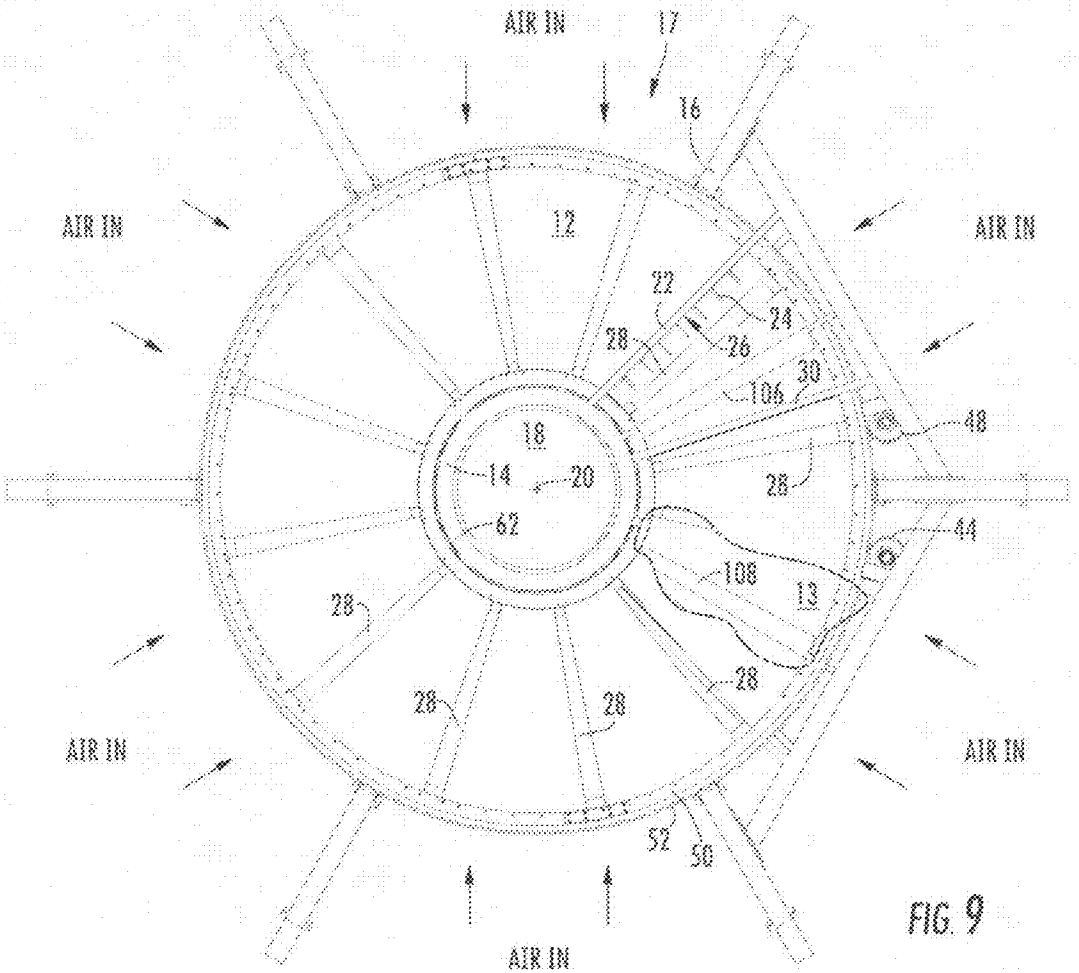
FIG. 9 is a plan view above one of the trays of the tray dryer that has a cut-out portion to illustrate a deflector below the upper tray.

With reference now to FIG. 9, a top view of a portion of the tray stack 17 is shown in which tray 12 is associated with a deflector 106 that functions to deflect material onto the surface of tray 12 when an opening 28 of tray 12 is located immediately below deflector 106 and aligned with an opening 28 of a tray immediately above tray 12. A cut-out portion of tray 12 is shown in order to view tray 13 that is immediately below illustrated tray 12. Tray 13 has a deflector 108 associated therewith that functions in the same manner as deflector 106 of tray 12. Deflector 108 functions to deflect product onto tray 13 when product 84 falls through opening 28 of tray 12 when an opening 28 of the tray 13 is aligned with opening 28 of tray 12. Since tray 13 is rotating in an opposite direction to tray 12, deflector 108 extends in an opposite direction from deflector 106. In this regard, it may be desirable that the deflectors 106 and 108 extend from their proximal, connected end to their distal, unconnected end in the same direction as the direction of rotation of the tray 12 and 13 to which they are associated so that product 84 landing onto the tray 12 or 13 is not urged against the deflectors 106 or 108. This is not the case in other exemplary embodiments. The deflectors 106 and 108 are thus associated with trays 12 that are successively adjacent one another and are in effect mirror images of one another. However, this need not be the case in all exemplary embodiments. The deflectors 108 can be arranged and angled with respect to the trays 12 to which they are associated in the same manners as previously discussed with respect to deflectors 106. A deflector 106/108 may not be needed on the very top tray 12 of the tray stack 17 because the openings 28 of the top tray 12 will not be aligned and below openings of a tray 12 directly above.

A series of deflectors 108 can be mounted at a different circumferential location about axis 20 than that of the series of deflectors 106. The deflectors 108 and 106 may be arranged so that only a single deflector 106 or 108 is associated with each one of the trays 12. As such, all of the deflectors 106 may be all mounted at the same circumferential location about axis 20. All of the deflectors 108 may be mounted at the same circumferential location about axis 20 that is at a different circumferential location than that of the deflectors 106. The deflectors 106 and 108 may be arranged so as to extend towards one another from their connected, attached locations. All of the deflectors 106 may be mounted to a different vertical support column 16 than the vertical support column 16 to which all of the deflectors 108 are mounted. However, other arrangements are possible in which all of the deflectors 106 and 108 are mounted to the same vertical support column 16. All of the deflectors 106 and 108 of the tray dryer 10 may be located at one of two circumferential locations about axis 20 such that no deflectors are located at any other circumferential location or arc length about the axis 20 other than these two circumferential locations and arc lengths.

Figure 12:
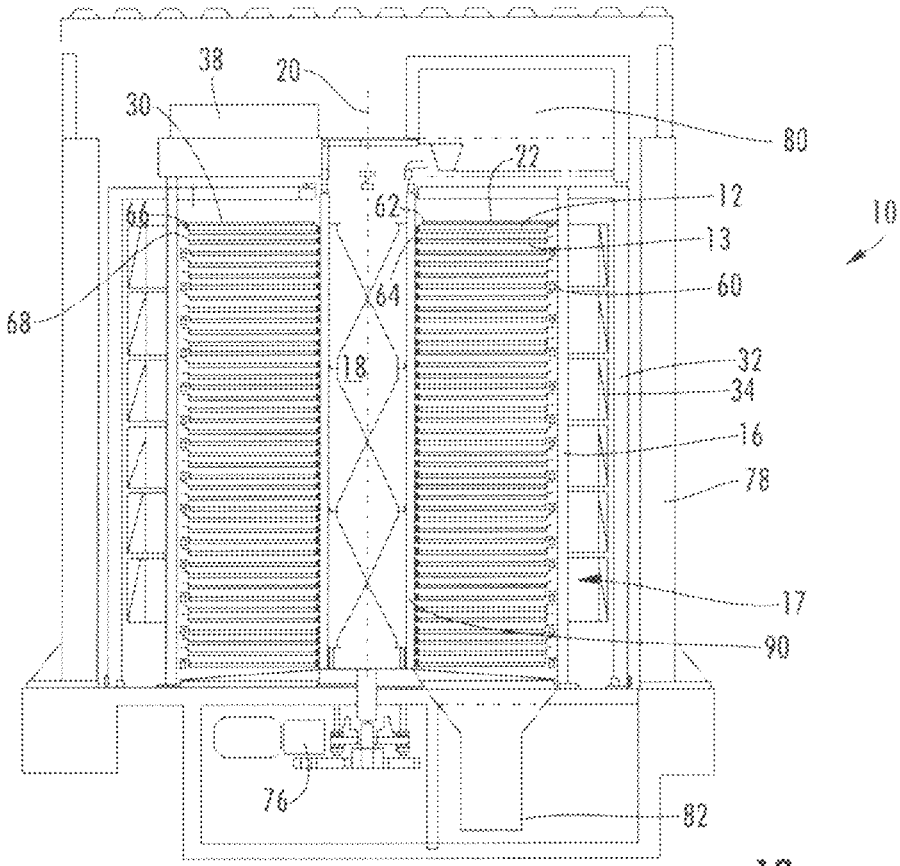
FIG. 12 is an elevation view of a tray dryer in accordance with another exemplary embodiment.
Figure 13:
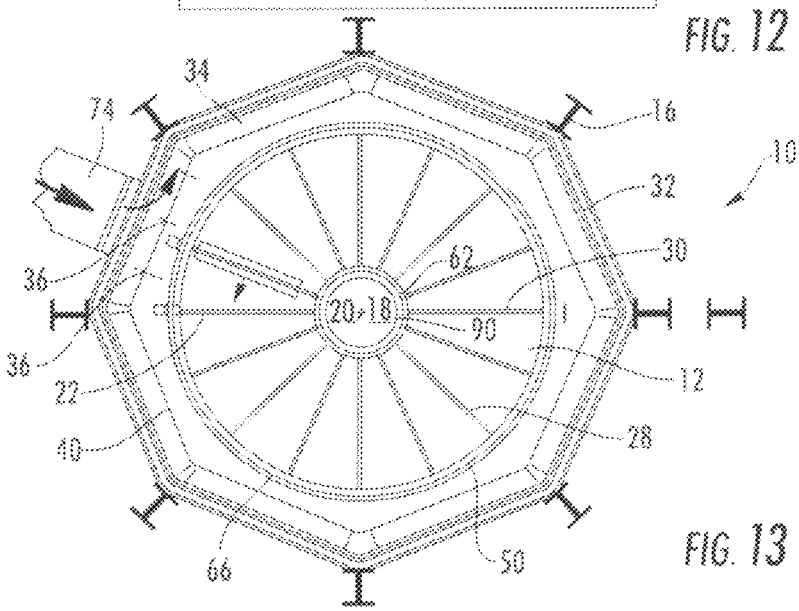
FIG. 13 is a plan view of the tray dryer of FIG. 12 above one of the trays of the tray dryer.

An additional exemplary embodiment of the tray dryer 10 is shown in FIGS. 12 and 13. The additional features shown in this exemplary embodiment may be incorporated into previously described exemplary embodiments. The tray dryer 10 includes trays 12 that are driven by a motor 76 that drives a central shaft 90. The trays 12 may be attached to the central shaft 90 such that they are attached to the central shaft 90 and not supported by rollers 58 on the inner support column 14. However, the outer rollers 60 may still be included in order to allow for a greater number of trays 12 per unit height of the tray dryer 10 to be realized. Heated air can be transferred through a side air inlet 74 and into one or more air plenum chambers 34 situated around the tray stack 17 and defined by the outer shell 32 and the inner shell 40. Air diffusers 36 can function to allow heated air to pass through the inner shell 40, onto product 84 located on the trays 12 and into a central opening 18 of the central shaft 90. The air may be exhausted through the central shaft 90 to an air filter/fan 80 located above the tray stack 17. The air filter/fan 80 may act to filter the exhaust air and also to drive the air through the tray dryer 10. The fan 80 may be used to form a vacuum at the top of the central shaft 90 to draw air through the tray dryer 10. In other arrangements, the fan 80 need not be present and another component may be used to create a vacuum for use in pushing air through the tray dryer 10. All of the aforementioned components may be contained within an outer housing 78 that may in some exemplary embodiments create an air lock so that air flow within the tray dryer 10 is controlled in a desired manner. Product 84 can be transported through the tray dryer 10 in a manner similar to that previously discussed and may exit the tray stack 17 at the bottom tray 12. The product 84 may fall through the tray 12 at the bottom of the tray stack 17 onto a removal conveyor 82 or other component and subsequently processed, packaged, or transported away.

Other exemplary embodiments of the tray dryer 10 are possible in which some of the trays 12 of the tray stack 17 are stationary while other trays 12 are capable of rotating. In this regard, the trays 12 may be arranged so that immediately adjacent trays 12 to rotating trays 12 are stationary trays 12. As such, the trays 12 alternate from stationary, to rotating, to stationary, to rotating, and so forth in the vertical direction of the tray stack 17. The trays 12 that rotate may have a material leveler 22 and/or a scraper 30 located at their upper surface and at their lower surface so that product 84 can be moved through the tray stack 17 in a manner similar to that previously discussed. Other exemplary embodiments are possible. For example, in certain embodiments the material levelers 22 and/or scrapers 30 may rotate while the trays 12 remain stationary. The material levelers 22 and/or scrapers 30 may be attached to a central shaft 90 or could be supported by the inner and/or outer support columns 14 and 16 and rendered rotatable with respect to the trays 12.

The inner support column 14 may be made of various components that form a structure that is closer to the axis 20 than the trays 12. The inner support column 14 may be made of a series of vertical support columns and rings that are attached to one another. The outer support column 16 could be made in a similar fashion with horizontally disposed components that generally form a ring around associated vertical support columns. The shaft 46 and associated gears 48 can be attached to a different vertical support column 16 than the shaft 42 and associated gears 44. Alternatively, the shaft 46 and gears 48 can be attached to a ring of the support column 16 and shaft 42 and associated gears 44 can be attached to the same ring of the support column 16 such that a vertical support column 16 is located between the attachment points of the shafts 46 and 42. The material leveler 22 can be attached to either a ring or to a vertical support column of the inner support column 14. Likewise, the sweeper 30 and deflectors 106, 108 can be attached to either a ring and/or a vertical support column of the inner support column 14.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A tray dryer for use in drying product, comprising:

an inner support column, wherein an axis extends in the vertical direction and the inner support column is located so that at least a portion of the inner support column is located from the axis in the radial direction;

a tray stack having trays that rotate about the axis, wherein the product is transferred between the trays of the tray stack;

an outer support column that is located such that at least a portion of the tray stack is located between the outer support column and the inner support column in the radial direction, wherein the inner support column and the outer support column are stationary with respect to the axis; and a plurality of driving gears that engage the trays of the tray stack that rotate about the axis, wherein the driving gears are located such that the driving gears engage an outer edge of the trays of the tray stack that rotate about the axis.

2. The tray dryer as set forth in claim 1, wherein each one of the trays of the tray stack that rotate about the axis is engaged by and driven by at least one of the driving gears.

3. The tray dryer as set forth in claim 1, further comprising a plurality of rollers that are mounted to the inner support column and to the outer support column, wherein the trays of the tray stack that rotate rest onto the rollers so as to be rotationally mounted to the inner support column and to the outer support column.

4. The tray dryer as set forth in claim 1, wherein the trays of the tray stack that rotate do so in an opposite direction to immediately successive trays of the tray stack that rotate such that no two immediately successive trays of the tray stack that rotate do so in the same direction.

5. The tray dryer as set forth in claim 1, wherein the trays of the tray stack that rotate have openings through their upper surfaces through which the product drops, and further comprising:

deflectors that are stationary with respect to the inner support column and the outer support column, wherein the deflectors are positioned such that when openings of successive trays of the tray stack align with one another due to rotation of the trays at a circumferential location about the axis the product falling through one of the openings contacts the deflector so that the product does not immediately fall through the aligned opening of the successive tray of the tray stack.

6. The tray dryer as set forth in claim 5, wherein the deflectors are located at either one of two circumferential positions about the axis and are not located at any other circumferential position about the axis, wherein each of the deflectors extends from a proximal attached position to a distal tip at an angle that is from 5° to 85° to the upper surface of the tray immediately below the deflector.

7. The tray dryer as set forth in claim 1, wherein some of the driving gears are attached to and rotated by a counterclockwise driving shaft, and wherein the rest of the driving gears are attached to and rotated by a clockwise driving shaft, wherein the counterclockwise driving shaft is mounted onto an outer vertical support column of the outer support column, and wherein the clockwise driving shaft is mounted onto an outer vertical support column of the outer support column that is different than the outer vertical support column to which the counterclockwise driving shaft is mounted.

8. A tray dryer for use in drying product, comprising:

a tray stack having trays that rotate about an axis, wherein the trays each define at least one opening that extends along the radial direction of the tray and that extends in the axial direction through the tray, wherein the product is transferred through the openings so as to be transferred between the trays of the tray stack;

an inner support column, wherein the axis extends in the vertical direction and the inner support column is located so that at least a portion of the inner support column is located from the axis in the radial direction from the axis;

an outer support column that is located such that at least a portion of the tray stack is located between the outer support column and the inner support column in the radial direction, wherein the inner support column and the outer support column are stationary with respect to the axis; and a plurality of driving gears that engage the trays of the tray stack that rotate about the axis, wherein the driving gears are located such that the driving gears engage an outer edge of the trays of the tray stack that rotate about the axis; and wherein an uppermost tray of the tray stack is the highest tray of the tray dryer in the vertical direction, wherein the product is deposited onto an upper surface of the uppermost tray of the tray stack and wherein drying air flows over the product that is present on the upper surface of the uppermost tray of the tray stack, and wherein drying air exits through an interior of the tray stack that is located closer to the axis in the radial direction than the upper surfaces of the trays of the tray stack.

9. The tray dryer as set forth in claim 8, further comprising four air plenum chambers located radially outwards of the tray stack, wherein the four air plenum chambers provide drying air to the tray stack, wherein the four air plenum chambers are arranged vertically with respect to one another, wherein drying air temperature and flow rate is independently provided with respect to each of the four air plenum chambers such that vertically successive air plenum chambers dispense increasing drying air temperatures and flow rates versus the previous air plenum chamber.

10. The tray dryer as set forth in claim 8, further comprising:

an outer shell;

an inner shell that is located radially inward of the outer shell and that is, located radially outward of the tray stack, wherein a pair of access doors are defined through the outer shell and the inner shell to allow access to the tray stack, wherein the pair of access doors are located circumferentially 180° apart from one another about the axis.

11. The tray dryer as set forth in claim 8, further comprising a material leveler that is stationary with respect to the rotating trays of the tray stack, wherein the material leveler has a leveling surface that engages the product as the product is transported past the material leveler on an upper surface of one of the trays of the tray stack, wherein the material leveler has a plurality of prongs that engage the product and that in combination with the leveling surface form a series of rows in the product on the upper surface of one of the trays, wherein the material leveler does not function to hold the product for transfer to a subsequent tray of the tray stack, wherein the series of rows extends at least 180° about the axis.

12. The tray dryer as set forth in claim 8, wherein product present on an upper surface of at least one of the trays has a series of rows formed therein, that are concentric about the axis and extend at least 180° about the axis, and wherein drying air flows over the product in the radial direction towards the axis so as to flow over the rows formed in the product.

* * * * *